United States Patent [19]

Chielens et al.

[11] 4,295,825

[45] Oct. 20, 1981

[54] SYSTEM FOR THE PROTECTION OF THE DELIVERY END OF A ROTARY KILN

[75] Inventors: Alain Chielens, Marcq en Baroeul; Bernard Boussekey, Lille, both of France

[73] Assignee: Fives-Cail Babcock, Paris, France

[21] Appl. No.: 100,239

[22] Filed: Dec. 4, 1979

[30] Foreign Application Priority Data

Dec. 7, 1978 [FR] France ..... 78 34456

[51] Int. Cl.[3] ..... F27B 7/38

[52] U.S. Cl. ..... 432/116; 432/119

[58] Field of Search ..... 432/77, 79, 81, 83, 432/84, 103, 115, 116, 119

[56] References Cited

U.S. PATENT DOCUMENTS

| | | | |
|---|---|---|---|
| 628,940 | 7/1899 | Hurry et al. | 432/116 |
| 2,169,512 | 8/1939 | Borch | 432/119 |
| 2,266,396 | 12/1941 | Lincoln et al. | 432/116 |
| 2,826,403 | 3/1958 | Moklebust | 432/115 |
| 3,016,236 | 1/1962 | Alonso | 432/119 |
| 3,042,389 | 7/1962 | Gieskieng | 432/115 |
| 3,330,546 | 7/1967 | Bryan | 432/119 |
| 3,682,453 | 8/1972 | Powell | 432/116 |
| 4,081,236 | 3/1978 | Corbett | 432/3 |

*Primary Examiner*—Henry C. Yuen

*Attorney, Agent, or Firm*—Kurt Kelman

[57] ABSTRACT

This invention concerns a system for the protection of the delivery end of a rotary kiln.

This system is characterized by the fact that it consists of a refractory concrete ring covering the internal surface of the end of the kiln shell and the front surface of a flange attached to the outside of the end of the shell, the ring being fastened to the shell and the flange by anchorage units fixed on them.

The invention can be used in the cement production and minerals processing industries.

8 Claims, 3 Drawing Figures

SYSTEM FOR THE PROTECTION OF THE DELIVERY END OF A ROTARY KILN

This invention concerns a system for the protection of the hot product delivery end of a tubular rotary kiln.

Known protection systems have consisted of a ring made up of several sections mounted onto the end of the kiln shell and cooled by air circulation. This ring is subjected to very high temperature and, if the product involved is of an abrasive nature, wear is considerable. For this reason, the life of this ring is relatively short, and its sections require frequent replacement. As these sections are of a complex nature and are usually made of cast steel, replacement is costly. In addition, certain mountng methods render removal of worn units very difficult.

The aim of the invention is to produce a simple and less expensive protection system.

This new protection system is characterised in that it consists of a refractory concrete ring covering the internal surface of the end of the kiln shell and the front surface of a radially outwardly extending flange attached to the end of the shell, the ring being attached to the shell and the flange by anchorage means fixed on both of the latter.

The surface of the shell covered by the concrete ring is limited towards the inside of the kiln, by a ring which is welded to the shell and acts as a stop for the brickwork of the kiln in such a way as to eliminate parasitic thrusts onto the ring. It is preferable that some play exists in the connections between the anchorage means and the shell or flange to allow differential expansion of the ring, the shell and the flange; provision has been made for expansion joints on the ring.

A rim fixed onto the external edge of the flange provides peripheral support for the ring. This rim can be lengthened towards the rear of the flange and join up with a shell concentric to the kiln shell and forming, with the latter, a duct having a ring-shaped cross-sectional area for the circulation of cooling air. This duct can be divided into a feed and a return channel by a third shell positioned between the other two and ending at a certain distance from the flange in such a way that the cooling air travelling along the feed channel comes into contact with the rear surface of the flange and then travels through the return channel along the kiln shell.

It is preferred that the ring be divided into two parts along a cylindrical surface extending approximately in prolongation of the internal surface of the shell. In this case, the external part of the ring which is attached to the flange is built first, and then the internal part which is attached to the shell and rests against the external part.

The external part of the ring can be made of prefabricated concrete blocks fastened to metallic supports which are attached to the end of the shell by means of bolts, keys or any other method of attachment; the flange and the rim are then made up of elements constituting these supports.

Other characteristics of the invention will appear on reading the following description which refers to the accompanying drawings which show only one of the many possible methods of constructing the system.

Figure 1:
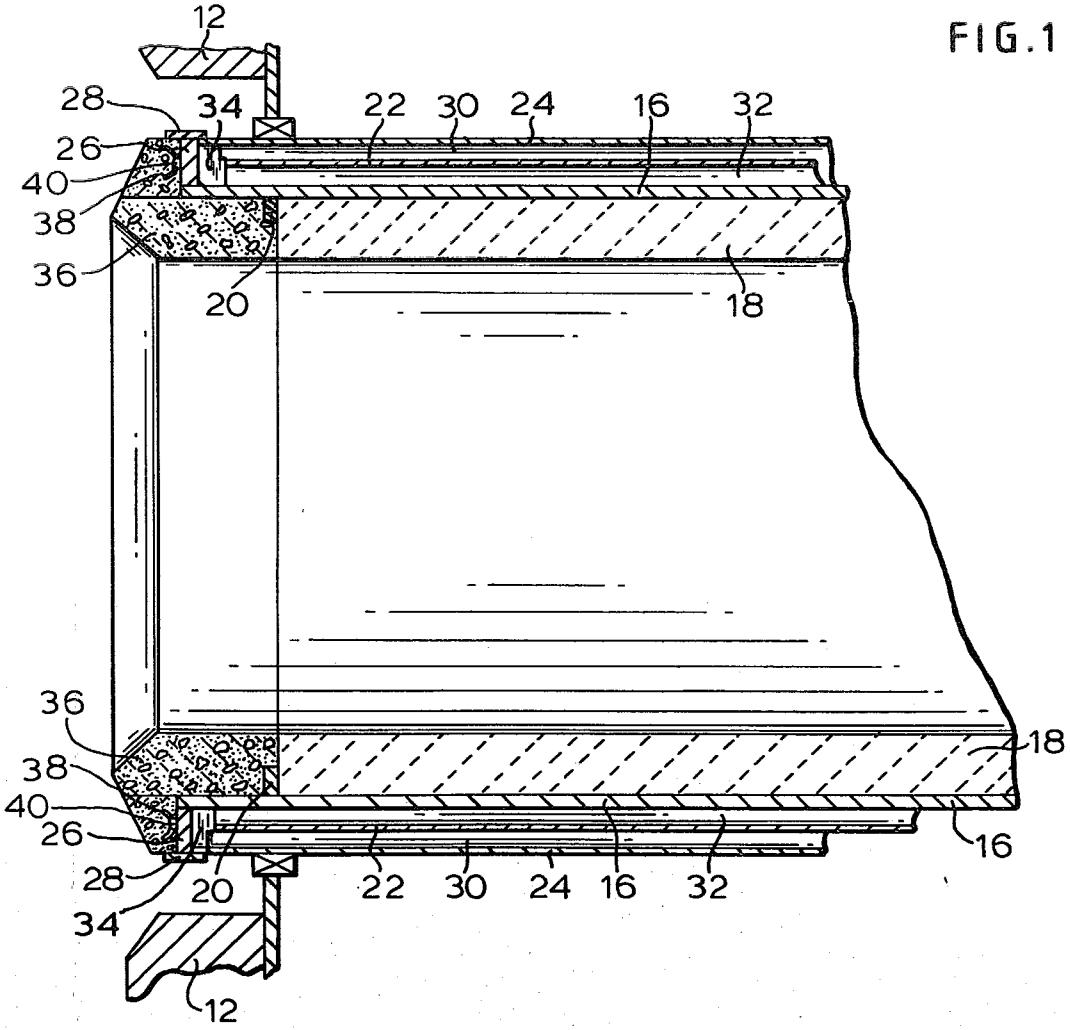
FIG. 1 is a diametrical cross-section of the delivery end of a tubular rotary kiln constructed according to the invention.
Figure 2:
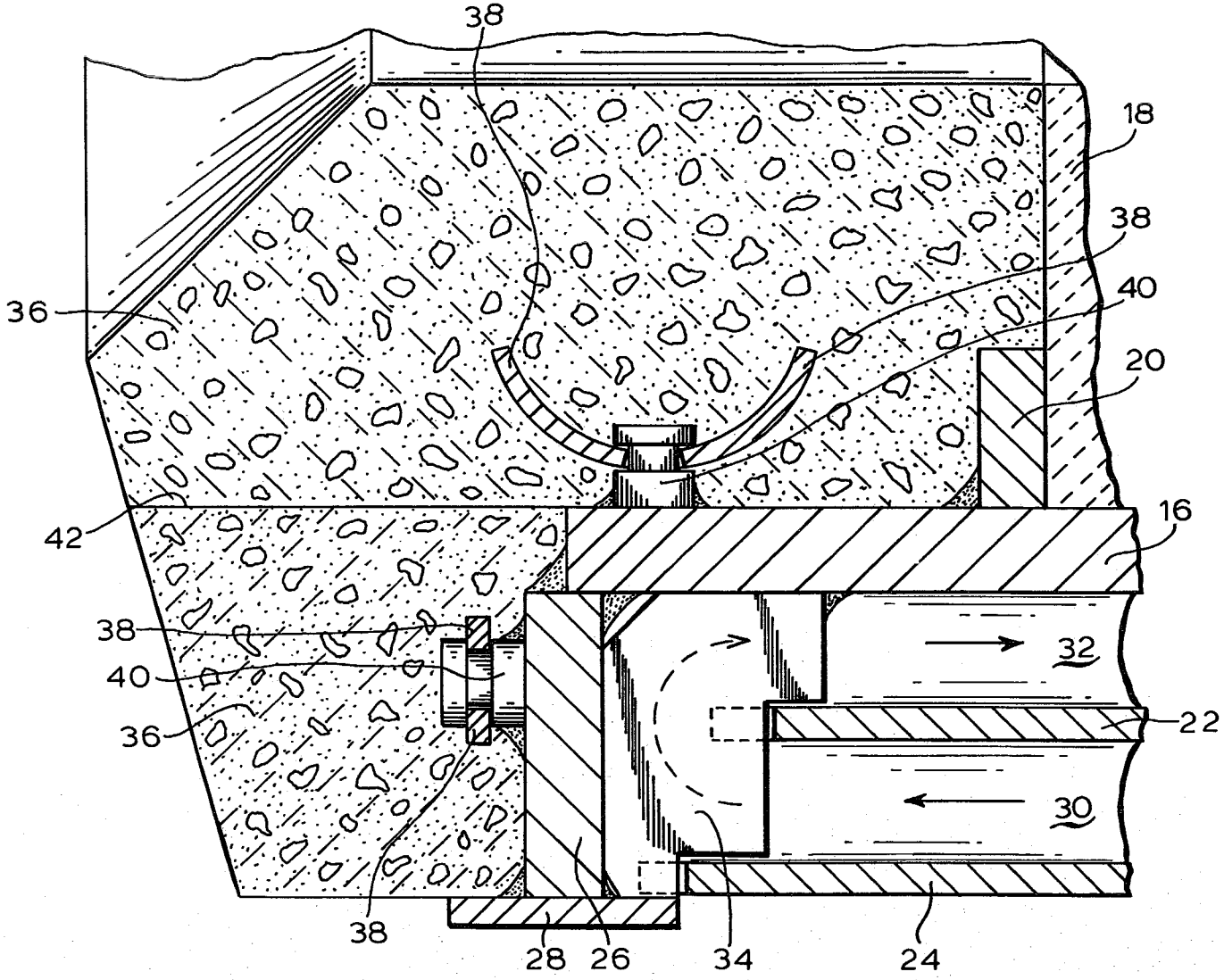
FIG. 2 is a larger-scale cross-section of the end of the kiln.

FIG. 1 shows the end of a tubular rotary kiln ending into a stationary housing 12 fitted with a burner (not shown). The hot product is discharged by gravity from this end of the kiln. The kiln consists of a metal shell 16 and an internal lining of refractory bricks 18. This lining stops at a certain distance from the end of the shell where a stop ring 20 is welded inside the shell.

The kiln is surrounded by two concentric shells 22 and 24 assembled and attached to shell 16 by flexible spacers.

An external flange 26, whose plane is perpendicular to the axis of the kiln, is welded onto the edge of the shell 16 by its internal edge. A rim 28 is welded onto the external edge of flange 26 and extends on both sides of the latter. The rear part of rim 28 surounds, with a small amount of play, the adjacent end of shell 24. The end of shell 22 is spaced from flange 26 in such a way as to form an annular opening through which the ducts 30 and 32 formed by shells 16, 22 and 24 communicate one with another. Fresh air brought in through outside duct 30 can in this way come into contact with flange 26 and then shell 16 to cool them, as shown by the arrows on the figures.

Ribs 34 stiffen the flange-shell assembly and support the ends of shells 22 and 24.

The end of shell 16 and the flange 26 are protected by a ring of refractory concrete 36 which covers the internal surface of the shell, between the stop-ring 20 and its end, and the front surface of the flange. This ring is attached to the shell and the flange by means of anchorage units attached to them. In the example given, these units are made up of cambered parts 38 mounted with an amount of play on studs 40. The amount of play provided allows differential expansion of the ring, the shell and the flange. Obviously, other anchoring methods could be used.

A cylindrical joint 42 is provided for in ring 36 in prolongation of the internal surface of shell 16; this joint divides the ring into an internal and an external part. There is provision for joints placed in radial planes in the two sections of the ring to avoid the concrete ring breaking because of dynamic strain in the shell.

To build ring 36, the external part is cast first, and then the internal part, using formwork casings of appropriate shapes.

Figure 3:
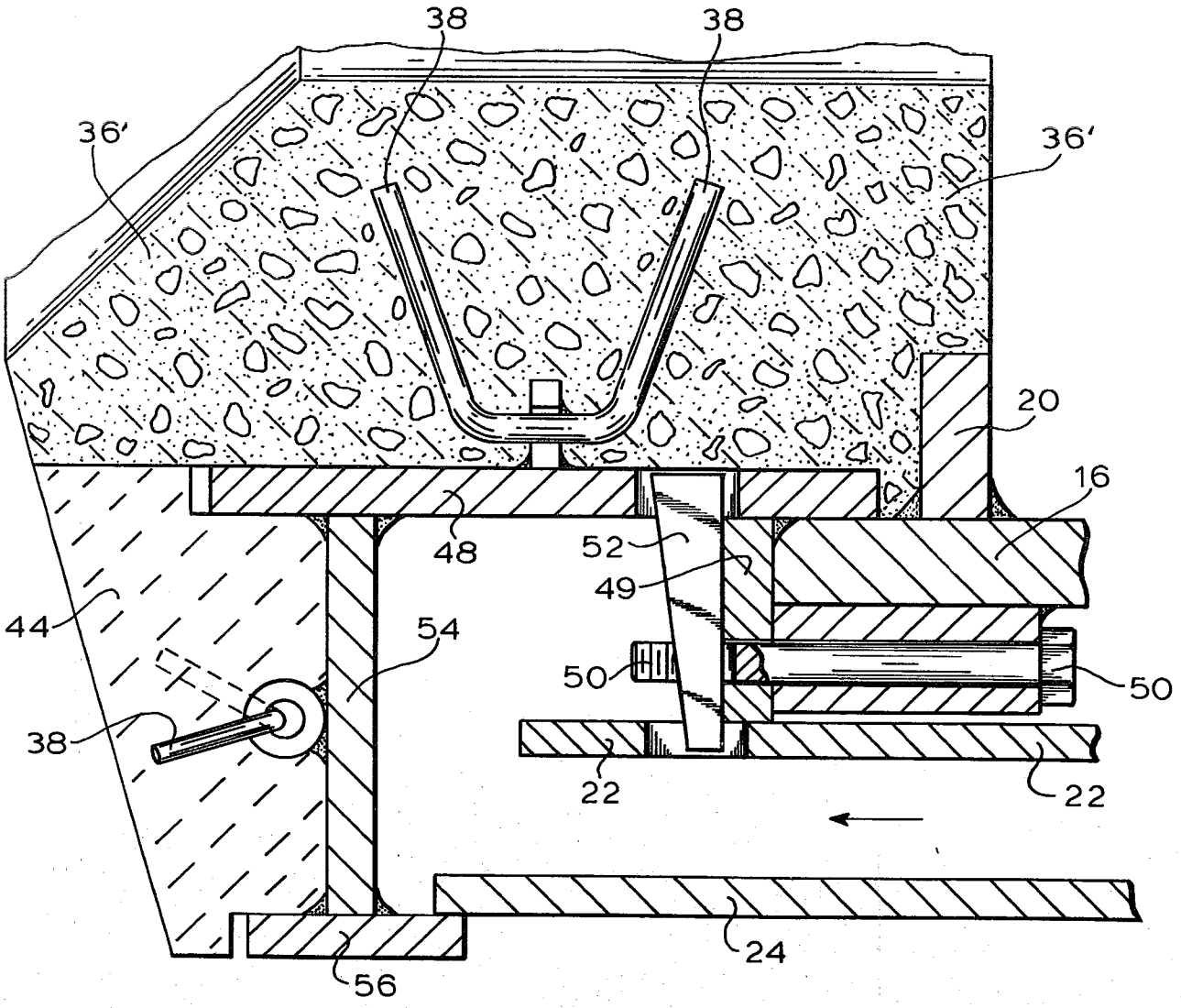
FIG. 3 is similar to FIG. 2, and shows a different construction method.

FIG. 3 shows another construction method in which the external section of the ring is made up of prefabricated concrete blocks 44. These blocks are cast onto a support to which they are attached by anchorage units 38. This support is made up of three welded parts 48, 54 and 56. Part 48 is arcuated and its end rests on the shell 16 of the kiln. This arcuate part is provided with lugs 49 attached by means of pins 50 and keys 52 to the shell 16. The second part 54 is placed perpendicularly to part 48 and has the form of a ring segment; the third one is an arcuated part 56 welded onto the edge of part 54 perpendicularly to the latter. When blocks 44 are in place, parts 54 form together a flange similar to flange 26 and parts 56 form together a rim similar to rim 28.

The internal part 36' of the ring is cast after blocks 44 have been set in place.

What is claimed is:

1. A tubular rotary kiln having a discharge end and comprising (a) metal shell having an internal and an external surface, the metal shell terminating in an end adjacent the discharge end, (b) a refractory lining covering the internal shell surface up to a distance from the shell end and leaving a remaining portion of the internal shell surface uncovered, (c) a flange fastened to the shell end at the discharge end of the kiln and extending radially outwardly from the shell, the flange having a front face and a rear face, (d) a discharge end protective device including a refractory concrete ring covering the uncovered portion of the internal shell surface and the front face of the flange, the refractory concrete ring being anchored to the shell and to the flange, and (e) means for circulating cooling air along the rear face of the flange and the external shell surface.

2. The tubular rotary kiln of claim 1, further comprising a ring secured to the internal surface of the metal shell at said distance and acting as a stop for the refractory lining.

3. The tubular rotary kiln of claim 1, further comprising a peripheral rim affixed to the flange and supporting the refractory concrete ring.

4. The tubular rotary kiln of claim 1, wherein the refractory concrete ring is comprised of a radially internal part and a radially external part, the ring parts adjoining each other along a cylindrical surface which is coaxial with the metal shell.

5. The tubular rotary kiln of claim 1, wherein the refractory concrete ring has radial joints.

6. The tubular rotary kiln of claim 1, further comprising a flange support element fastened to the shell end at the discharge end of the kiln and supporting the flange, the flange support element and flange forming a unit and the refractory concrete ring being comprised of prefabricated blocks anchored to the flange support element and to the flange.

7. The tubular rotary kiln of claim 6, wherein the flange support element and flange unit consists of several parts.

8. The tubular rotary kiln of 1, wherein the cooling air circulating means comprises two concentric ducts surrounding the metal shell at the discharge end, the ducts being arranged to supply the cooling air to the rear face of the flange and to the external metal shell surface.

* * * * *